US008287224B2

(12) United States Patent
Carpinelli

(10) Patent No.: US 8,287,224 B2
(45) Date of Patent: Oct. 16, 2012

(54) APPARATUS AND METHOD FOR INVERTING BEVERAGE GLASSES

(76) Inventor: Marc A Carpinelli, Kansas City, MO (US)

( * ) Notice: Subject to any disclaimer, the term of this patent is extended or adjusted under 35 U.S.C. 154(b) by 437 days.

(21) Appl. No.: 12/558,870

(22) Filed: Sep. 14, 2009

(65) Prior Publication Data

US 2011/0064549 A1 Mar. 17, 2011

(51) Int. Cl.
*B65B 67/02* (2006.01)

(52) U.S. Cl. ..... 414/405; 414/404; 414/419; 414/758; 414/810; 53/260; 53/299; 53/392

(58) Field of Classification Search ..... 414/404, 414/405, 419, 758, 767, 810; 53/260, 284, 53/299, 319

See application file for complete search history.

(56) References Cited

U.S. PATENT DOCUMENTS

| | | | | |
|---|---|---|---|---|
| 841,299 | A * | 1/1907 | Young | 414/405 |
| 1,110,256 | A * | 9/1914 | Dagleish | 414/405 |
| 5,360,309 | A | 11/1994 | Ishiguro | |
| 6,699,006 | B2 * | 3/2004 | Schlimgen et al. | 414/801 |
| 6,851,920 | B2 * | 2/2005 | Trautwein et al. | 414/798.4 |
| 7,690,883 | B2 * | 4/2010 | Huber et al. | 414/790.4 |

* cited by examiner

*Primary Examiner* — Scott Lowe

(57) ABSTRACT

The disclosure depicts an apparatus and method for transferring beverage glasses from a first a beverage glass containment rack to an empty second beverage glass containment rack. Each rack includes side walls and a plurality of chambers arrayed within the perimeter. Each chamber of the rack is adapted to contain a beverage glass. The apparatus has side walls bearing edges adapted to engage the perimeter of the glass rack when in a mounted position. It also has a center divider within an interior of the apparatus and orthogonal its side walls. A plurality of ducts is arrayed within the side walls, each respective duct passing through and coupled to the center divider such that each respective duct is positioned to fit within a respective chamber when in the mounted position.

19 Claims, 8 Drawing Sheets

FIG 1
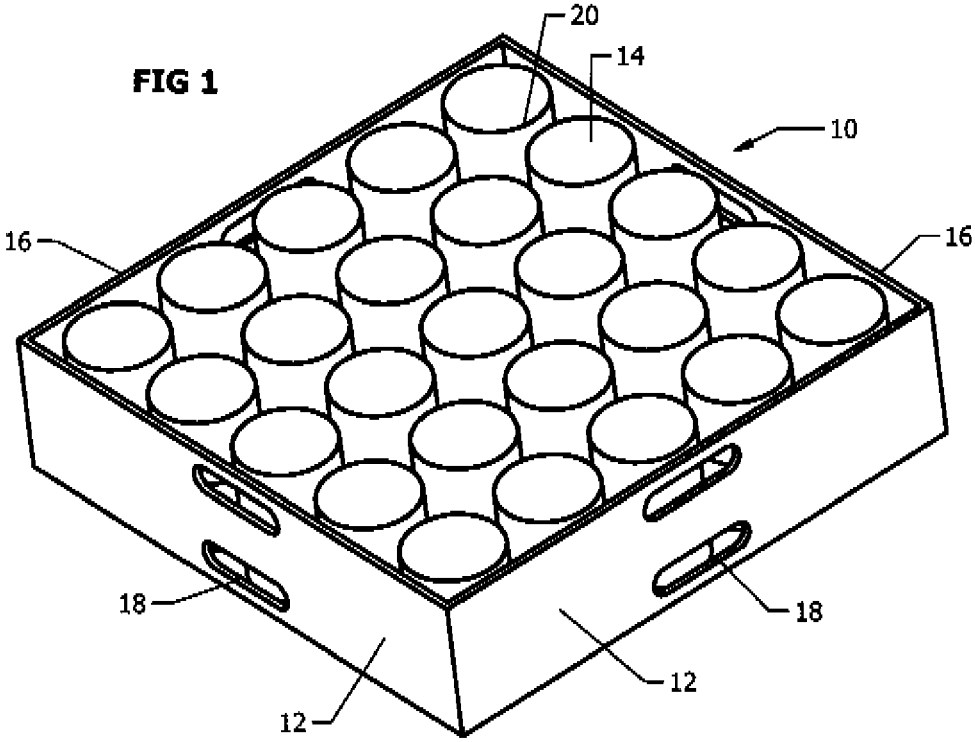
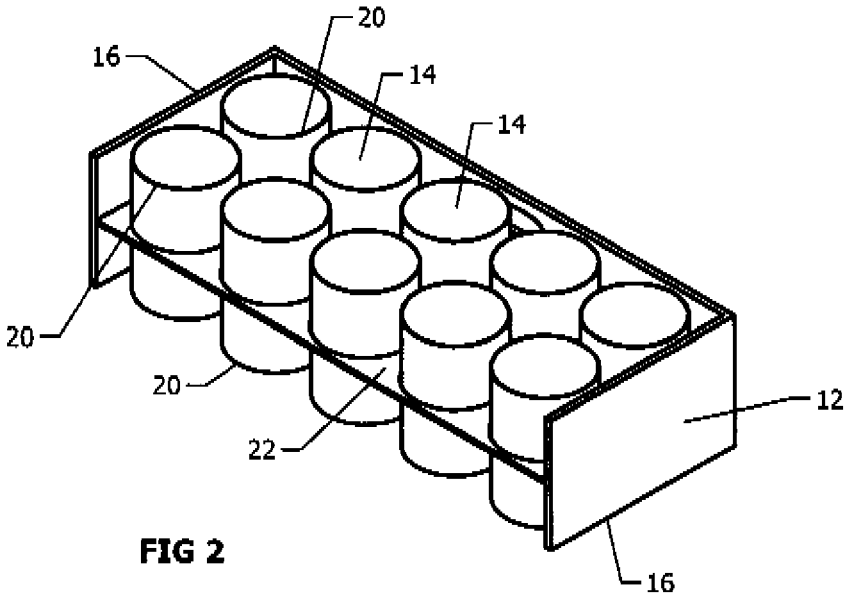
FIG 2

FIG 3
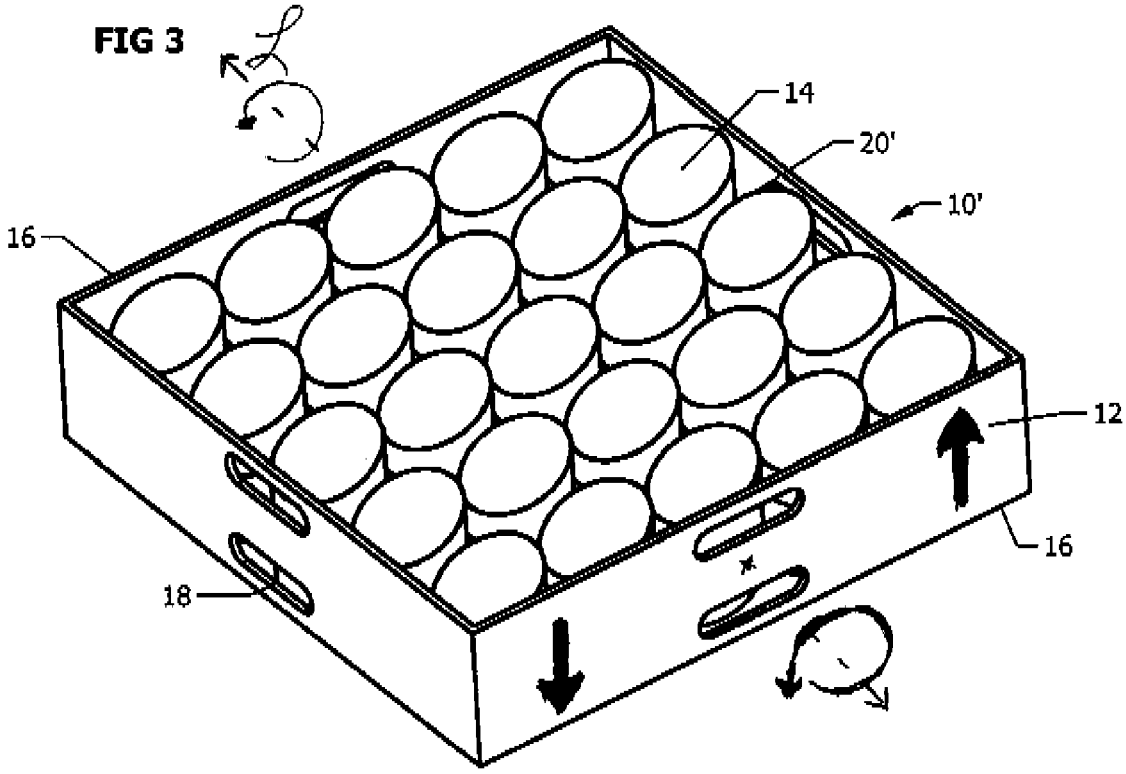
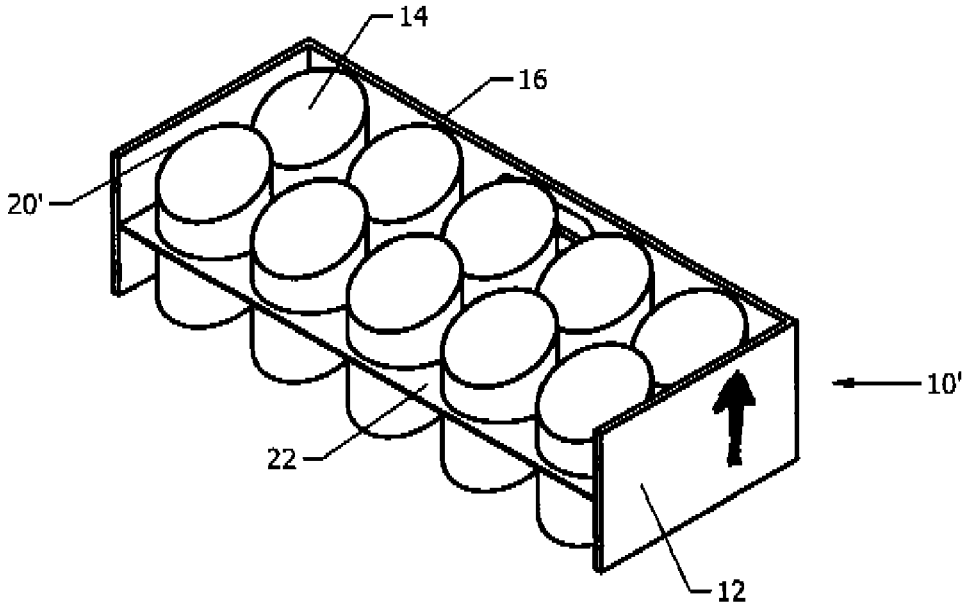
FIG 4

APPARATUS AND METHOD FOR INVERTING BEVERAGE GLASSES

BACKGROUND OF THE INVENTION

The invention is a system and method that eases the task of inverting multiple beverage glasses within a standard beverage glass rack.

At large restaurants, banquet facilities or anywhere that beverages are served to large numbers of people, glasses are often inserted into racks so that multiple beverage glasses may be washed all at once in a commercial type dish washer. Prior to the guests' arrival, it is commonly known in the industry to use those same racks to transport these same beverage glasses, which have been freshly filled with ice, over to a centralized banquet table for guests self service or placed individually on the tables, one in front of each seating placement. Here the glasses wait until just prior to the guests' arrival, when at such time the glasses with fresh ice will be then filled with water. However, the challenge is that when running the beverage glasses through a dishwashing cycle in a standard beverage glass rack, the glasses must be washed upside down. Of course, the glasses must be right-side-up in order to fill the glasses with ice and beverage. Thus, each glass must be removed from rack after being washed, then inverted in the rack before the glasses could be filled.

This common industry practice requires more time and costly manual labor to invert by hand each and every beverage glass within the standard beverage glass rack before adding ice and beverage to the glasses.

Conversely, at the end of the banquet meeting, another common industry practice is for the clean up crew to place these used dirty glasses back in to standard beverage glass racks in their right-side up position (because some glasses have unused liquid and ice in them, they can not be placed in the upside down position) and bring them back to the kitchen area where a dishwashing person reverses the right-side up glasses to the bottom-up orientation in the rack before running the rack of glasses in a dishwasher, which requires time and costly manual labor.

Another common industry process is that when it is time to clean up the facility and bring the dirty glasses back to the dishwashing area in the kitchen for washing, instead of the clean up crew putting them back in the beverage glass containment racks as mentioned above, they put them in what is commonly known as a bus tub (a plastic rectangular open container), and then bring the bus tubs to the dishwashing area in the kitchen where the dishwasher then has to take the glasses back out of the bus tubs and place them back into beverage glass containment racks in to their upside down position, ready for washing.

Instead the dirty glasses filled with unused water and ice may be put back in the empty beverage glass containment racks right there in the banquet area in their usual upright position with their open ends facing up (still containing unused liquid or ice) transported to the kitchen sink area, where using this apparatus the glasses can be inverted to the upside down position, ready to wash, which avoids the step of using bus tubs altogether, again saving more time and costly manual labor.

The best mode for use of this invention addresses this time consuming and costly aspect of the current, conventional industry practice that requires manual labor to invert each and every glass within its respective chamber of a beverage glass containment rack.

SUMMARY OF THE INVENTION

The invention is an apparatus and a method for inverting beverage glasses within an industry-standard beverage glass containment rack.

The Inventive Apparatus

The inventive apparatus is best used with a first beverage glass containment rack and a second beverage glass containment rack. Each of these racks has side walls terminating with an upper edge. Additionally, each standard rack has a bottom, and a plurality of chambers arrayed within the perimeter. Each chamber is adapted to contain a beverage glass. Beverage glasses should be loaded into the chambers of the first beverage glass containment rack.

The inventive apparatus has side walls bearing edges adapted to engage around the perimeter of each standard rack when in a mounted position. The apparatus also has a center divider orthogonal to the side walls. The center divider has openings that retain a plurality of arrayed transfer ducts. Each respective duct of the apparatus passes through the center divider and is positioned to fit within a respective chamber when in the mounted position atop a standard beverage glass containment rack.

An assembly is formed by engaging the apparatus between respective upper edges of the first containment rack and an empty second containment rack. As noted above, the containment racks should be substantially identical to one another (having an equal number of chambers), except that the rack on the bottom of the assembly will contain beverage glasses, but the rack above the apparatus will be empty. Generally, the edges of the apparatus engage around and extend over the edges of each beverage glass rack. Once the assembly is formed and the racks secured within the edges of the apparatus, the assembly is inverted by rotating it about an axis through the center divider.

Once the assembly is inverted, the glasses will pass from the first rack and into the empty rack by passing through respective ducts in the apparatus. When the first rack and apparatus are removed from the assembly, the beverage glasses will be neatly placed within the formerly-empty beverage rack, with their orientation reversed (i.e., the upside down glasses will now be right-side up and ready for filling).

Optionally, the apparatus may have at least one grip positioned on a side wall. These grips may include any known handle apparatus, or could also include elongate apertures formed in the side wall. In order to prevent unintended disassembly of the assembly during the inversion process, the edges of the apparatus frictionally should snugly fit and frictionally engage the perimeter of the glass rack. Therefore, it is preferred to cooperatively form the perimeter of the apparatus to retrofit the existing industry standard beverage glass containment racks. In order to ease the transfer process from one rack to the other, the edges of each duct may be angled with respect to the center divider. Preferably, each of the edges is uniformly angled with respect to the center divider so that each forms the same, angled relation with respect to the center divider.

The transferring ducts may comprise as least a portion that is made of pliable flexible material, or sturdy non flexible material.

The Inventive Method

The invention is also a method of transferring glasses from a first beverage glass containment rack to an empty second beverage glass containment rack. The method includes the steps of providing a first beverage glass containment rack and inserting beverage glasses into its chambers. The method also includes the step of providing an empty second beverage glass containment rack of generally-identical configuration with an equal number of chambers. Next, the method requires one to provide an apparatus having side walls that bear edges adapted to engage the perimeter of each beverage glass containment rack. This apparatus has a center divider that is orthogonal to the side walls.

The inventive method also includes the step of positioning a plurality of ducts within interior the side walls such that each duct passes through and is coupled to the center divider. Next, one engages edges of the side walls around the first beverage glass rack such that each respective duct engages within a respective chamber. Next, one forms an assembly by inverting an empty second rack and placing it atop the apparatus. Next, one inverts the assembly so that the second, empty beverage glass rack is now beneath the apparatus. This inversion urges the glasses to pass through the assembly and into the empty rack. By lifting both up altogether at one time, one removes the first beverage glass containment rack (now empty) and the apparatus from the assembly, leaving the glasses (now inverted) within the chambers of the second beverage glass containment rack.

Optionally, one may position at least one grip positioned on a side wall; the grips can be known handle apparatus or elongate apertures formed in the side walls. Additionally, the apparatus frictionally engages around the perimeter of the glass rack; this will help prevent the assembly from coining apart when the assembly is rotated and inverted, which is usually done by hand on a solid surface about waist high.

In an alternate embodiment of the inventive method, the ducts bear edges that are angled with respect to the center divider. Preferably, each of the edges is uniformly angled with respect to the center divider so that each forms the same, angled relation with respect to the center divider. The angling of the edges may ease the task of installing the apparatus onto the first beverage glass rack. Additionally, the ducts may comprise at least a portion that is made of pliable flexible material, or sturdy non flexible material.

Other objects, advantages and novel features of the present invention will become apparent from the following detailed description of the invention when considered in conjunction with the accompanying drawings.

BRIEF DESCRIPTION OF THE DRAWINGS

FIG. 1 is an isolated perspective view showing the apparatus, according to the principles of the invention.

FIG. 2 is a cross-sectional and perspective view of an apparatus shown in FIG. 1.

FIG. 3 is an isolated perspective view showing an alternate embodiment of the apparatus, according to the principles of the invention.

FIG. 4 is a perspective view showing a cross-section of the alternate embodiment that is shown in FIG. 3.

DETAILED DESCRIPTION OF THE PREFERRED EMBODIMENTS

Figure 5:
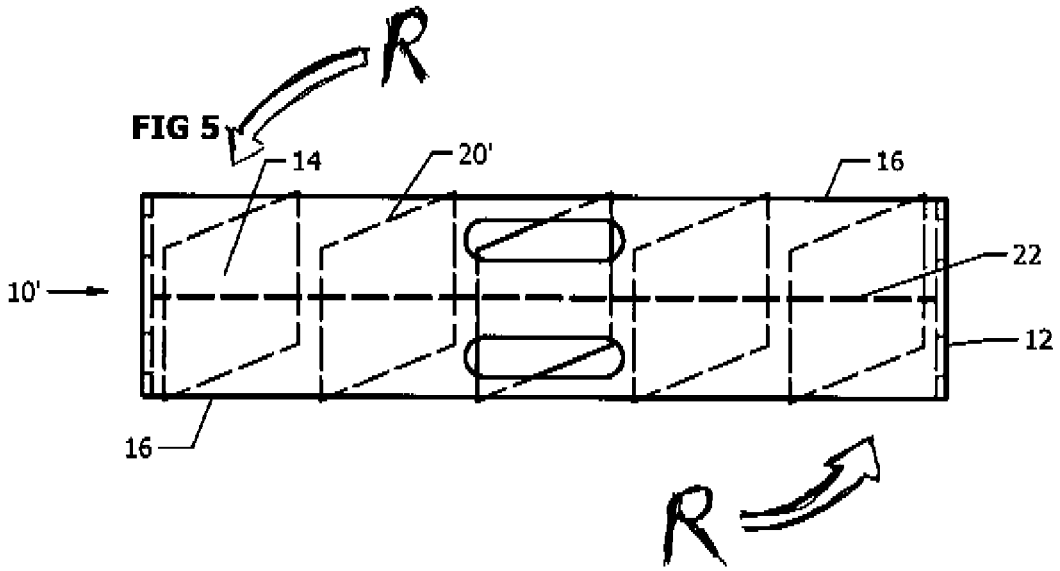
FIG. 5 is a side view detailing the embodiment shown in FIG. 3.

FIG. 1 is an isolated and perspective view of the apparatus 10. The apparatus 10 has side walls 12 that terminate in edges 16. The side walls 12 define a perimeter around an interior that contains a plurality of arrayed ducts 14 that pass through the apparatus. Preferably, the ducts 14 will each have a circular cross-section at planes generally parallel the edge 16 and perpendicular the side walls 12.

Still referring to FIG. 1, the apparatus 10 may bear grips 18 formed on the side walls 12. Typically, as shown, the grips 18 are elongate apertures formed in a central location of each side wall 12. However, the grips 18 may also be any known means to assist one in securing a good hand-hold of the apparatus, such as handles or knobs.

FIG. 2 is a cross-sectional and perspective view of the apparatus 10 that is shown in FIG. 1. As viewable in FIG. 2, a center divider 22 is positioned at a generally central location within the interior of the apparatus, and is orthogonal to the side walls 12. The ducts 14 are arrayed in a spaced apart relation by being coupled to a center divider 22 that is generally perpendicular to the side walls 12.

Still referring to FIG. 2, the top edges 20 of the ducts 14 are depicted as generally parallel the center divider 22. However, a preferred embodiment of the apparatus 10 angles the duct edges 20 with respect to the plane passing through the center divider 22.

FIG. 3 is an alternate embodiment of the apparatus 10'. This embodiment of the apparatus 10' has side walls 12 that form a frame around a plurality of ducts 14 coupled to a center divider 22 (not shown in FIG. 3; viewable in FIG. 4) interior the side walls 12. As shown in FIG. 3, the ducts 14 have edges 20' that are angled with respect to planes containing the edges 16 of the side walls 12. In order to invert beverage glasses, the apparatus 10' will be rotated about an axis L through the center divider 22 of the apparatus 10'. Preferably, the edges 20' are angled such that a portion of the edge 20' that is distal the axis of rotation L is displaced from the center divider a greater distance than the portion of the edge 20' that is more proximate the axis L.

Still referring to FIG. 3, arrows may be positioned on the side walls to indicate the preferred direction of rotation with respect to the orientation of the edges 20' of the ducts 14. Grips 18 may be positioned on side walls 12 of the apparatus 10' in order to facilitate rotation of the apparatus when used in combination with a pair of beverage glass containment racks. The arrows indicate a preferred direction of rotation with the embodiment that includes the angled edges 20'. When the edges are parallel the center divider, however (i.e., with the embodiment shown in FIGS. 1 and 2), the apparatus 10 may be rotated in either direction about axis L.

FIG. 4 is a perspective and cross-sectional view of the apparatus 10' that is depicted in FIG. 3. As shown, a center divider 22 passes through a generally central location of the interior of the apparatus 10' and is oriented generally orthogonal each side wall 12. A plurality of arrayed ducts 14 pass through and are coupled to the center divider 22. As shown in FIG. 4, the edges 20' of the ducts 14 are angled with respect to planes parallel the edges 16 of the side walls 12. Note that the edges 20' of the ducts 14 are angled such that a portion of the duct 14 that is distal the axis L is raised from the center divider.

FIG. 5 is a side view of the apparatus 10' that is shown in FIGS. 3 and 4. In the view shown in FIG. 5, the angled disposition of the edges 20' of the ducts 14 is more readily apparent. When the apparatus 10' is rotated in direction R, portions of the edges 20' that are above the center divider 22 and distal the axis of rotation are raised from the center divider 22. Conversely, portions of the edges 20' that are below the center divider 22 and distal the axes of rotation are more proximate the center divider 22 than portions of the duct 14 that are closer to the axis of rotation.

Figure 6:
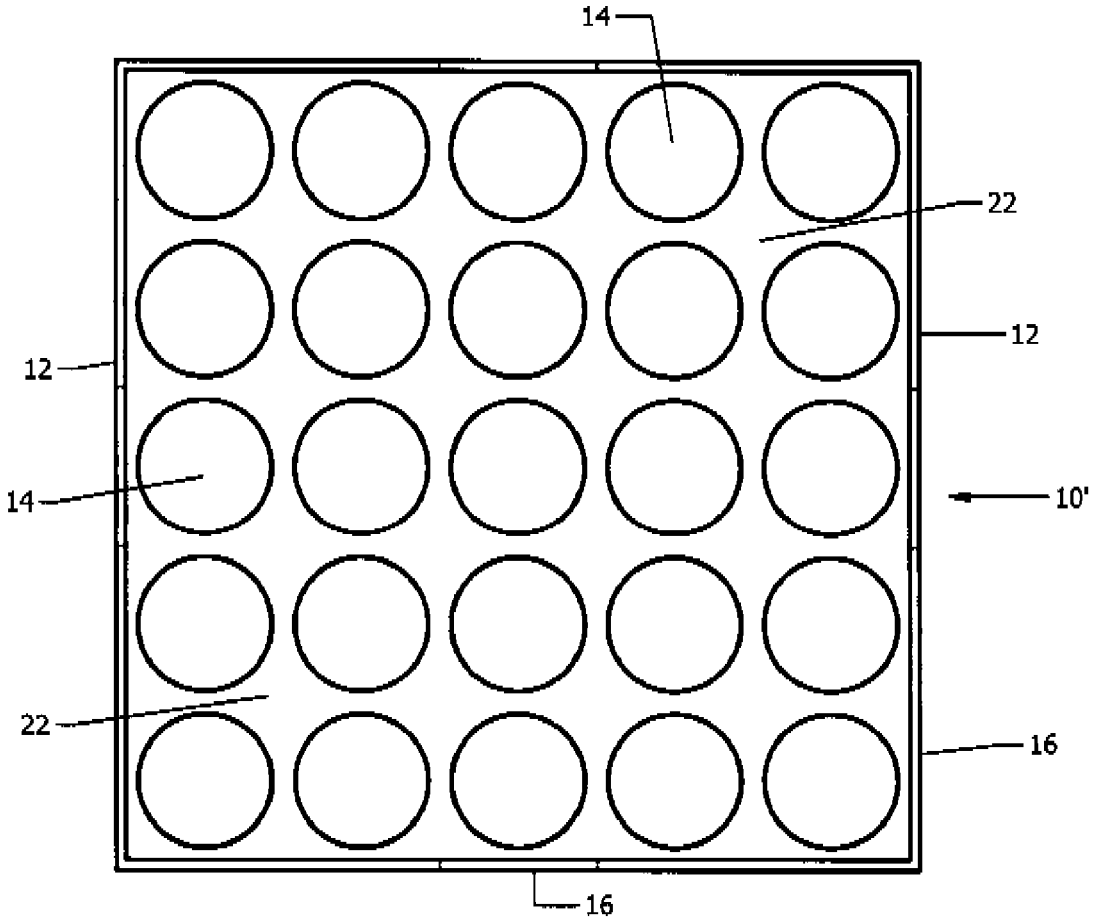
FIG. 6 is an isolated plan view of the apparatus.

FIG. 6 is an overhead, plan view isolating the apparatus 10. The apparatus has side walls 12 that terminate in edges 16. A center divider 22 is coupled to the interior of the walls 12, and ducts 14 pass through and are coupled to the center divider 22. The ducts 14 are shown to bear a circular cross-section when viewed at this plane; however, other cross-sectional orientations (such as polygonal shape) are also within the scope and spirit of the invention.

Figure 7:
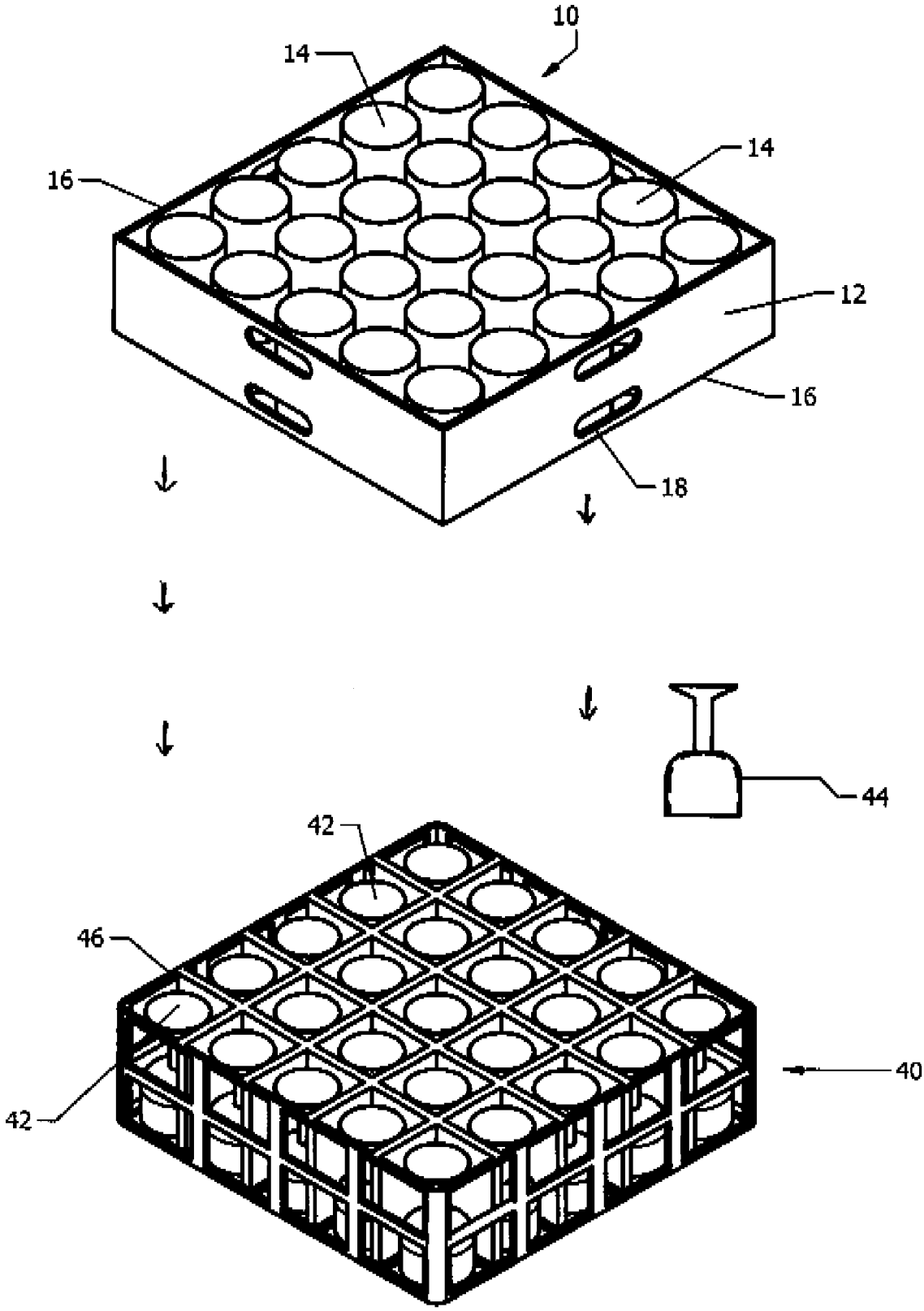
FIG. 7 is an exploded, perspective view of a beverage glass rack in combination with beverage glasses and the apparatus.

FIG. 7 is an exploded and perspective view of a standard beverage glass rack 40 in combination with the inventive apparatus. As shown, the rack 40 contains a plurality of arrayed chambers 42; each chamber 42 is configured to hold a single beverage glass 44. Each beverage glass 44 rests within a respective chamber 42 with a downward (i.e., bottom-up) orientation. The bottom-up orientation is required when inserting a rack 40 fill of glasses 44 into a dishwashing machine to be washed.

Figure 8:
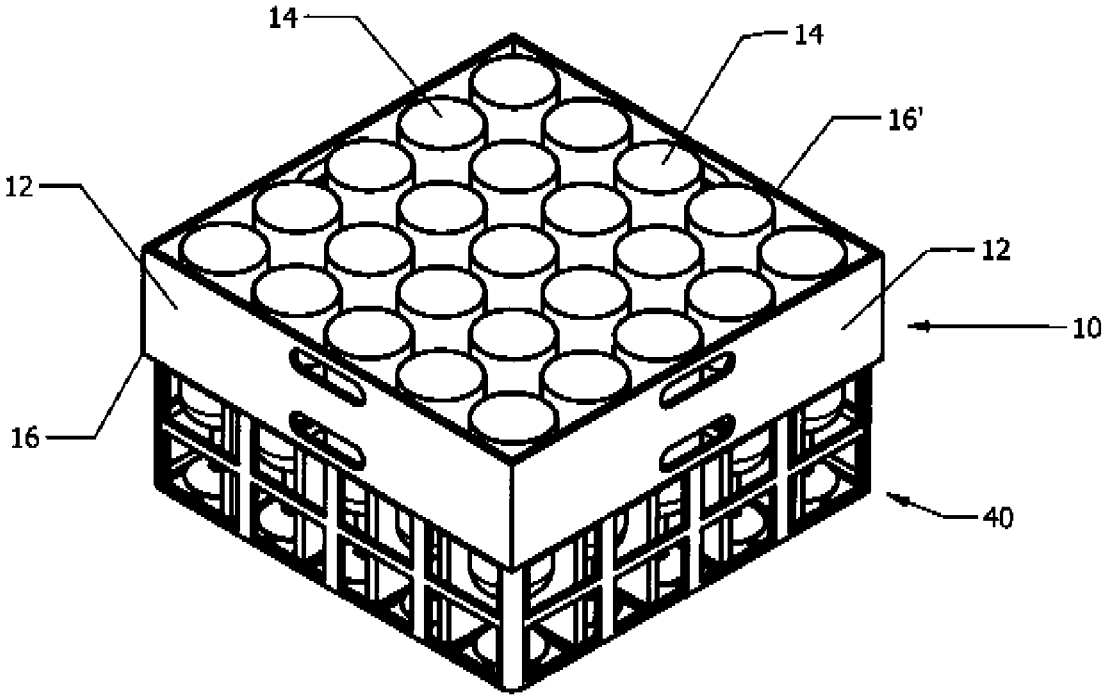
FIG. 8 is a perspective view of the apparatus atop a first beverage glass rack.

FIG. 8 is the apparatus 10 as it is placed atop the rack 40. The edges 16 of the apparatus 10 are formed to engage around the upper edge 46 of the rack 40. In like manner, the respective ducts 14 (on the apparatus 10) are cooperatively formed to engage within respective chambers 42 (of the rack 40; see supra). When assembled as in FIG. 8, the bottom of each respective duct 14 will depend at least partly into a respective chamber 42 (see supra) of the rack 40. Additionally, the bottom of the duct 14 should also depend past at least a portion (as shown, the bottom portion) of each glass 44.

Figure 9:
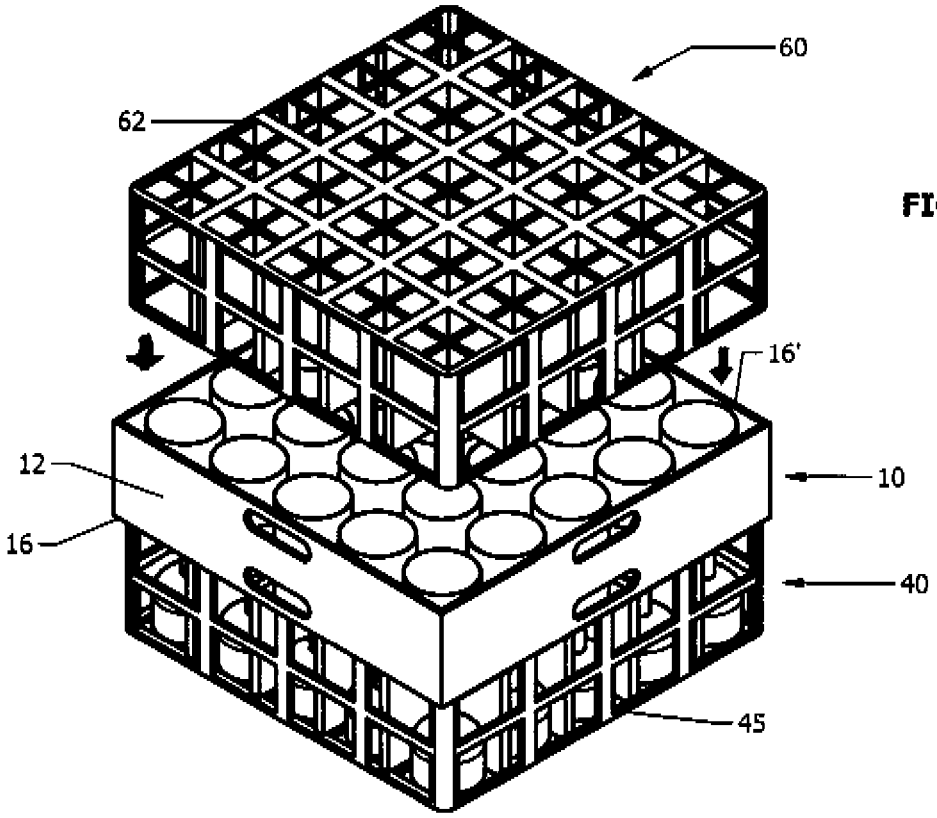
FIG. 9 is an exploded perspective view of the configuration depicted in FIG. 8 in combination with a second (and empty) beverage glass rack.

FIG. 9 is a perspective view of the combination depicted in FIG. 8 along with a second, empty beverage glass rack 60. Note that the second rack 60 is inverted so that its bottom 62 faces upward, and its top edge will engage within the upper edge 16' of the apparatus 10. As shown in FIG. 9, the second rack 60 should be virtually identical in configuration as the first rack 40. As the second rack 60 is lowered onto the apparatus 10, the respective ducts 14 fit within open chambers of the second rack 60, and the upper edge 16' of the apparatus 10 should engage snugly around the perimeter of the rack 60.

Figure 10:
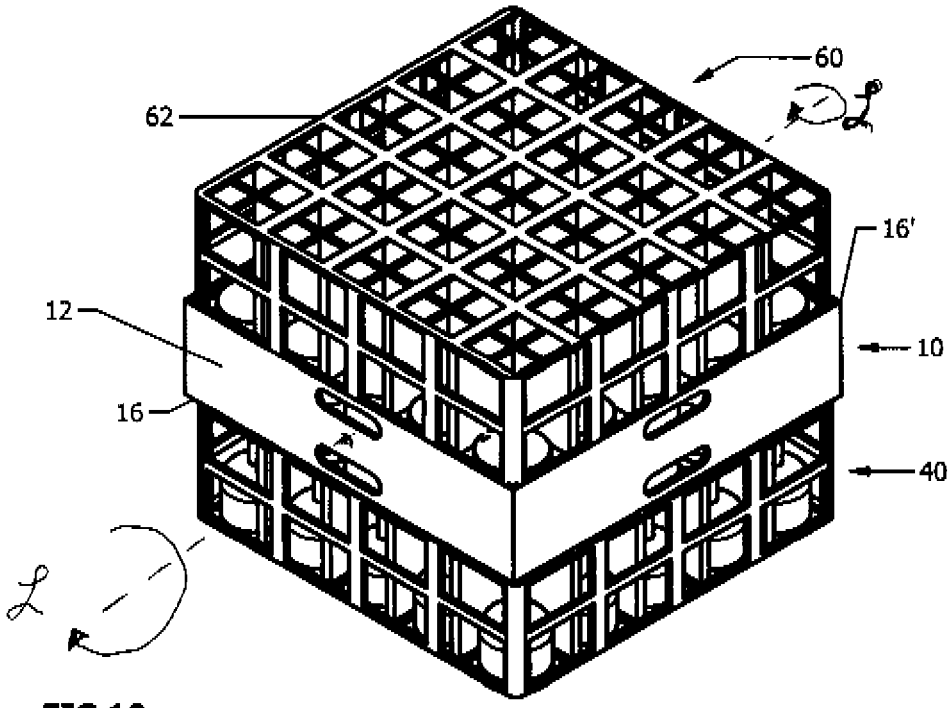
FIG. 10 is a perspective view of an assembly including a first glass beverage rack (glasses included) in combination with the inventive apparatus and a second (empty) beverage glass rack.

FIG. 10 is the combination of FIG. 9 with the second rack 60 lowered onto the apparatus 10 such that the apparatus 10 is sandwiched between the lower rack 40 (which contains the bottom-up glasses 44) and the upper rack 60 (which is presently empty). The three pieces 60, 10, and 40 form an assembly such that the upper edge of each rack 40, 60 engages the center divider 22 (see FIG. 2) of the apparatus 10, and each duct 14 (FIG. 1,2) passes at least partly into a chamber of each rack 40, 60. Once the parts of the assembly are fit together, the assembly is then inverted by rotating the assembly about an axis L that passes through the apparatus 10. Ideally, the parts of the assembly frictionally engage with one another so that only finger pressure is needed to keep the parts together during the inversion process.

Figure 11:
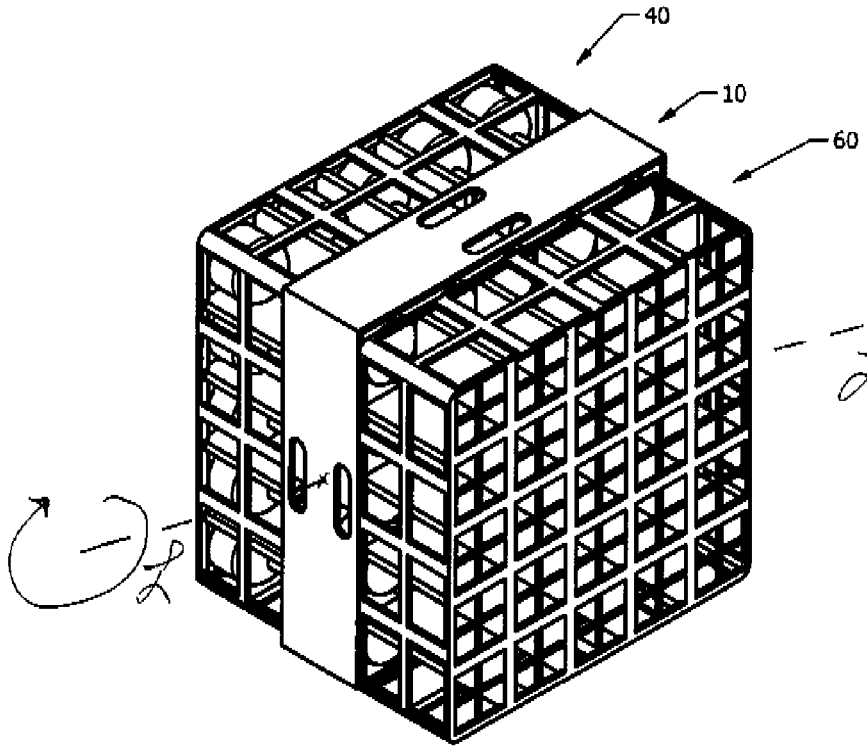
FIG. 11 is a perspective view of the assembly depicted in FIG. 10, rotated ninety degrees.
Figure 12:
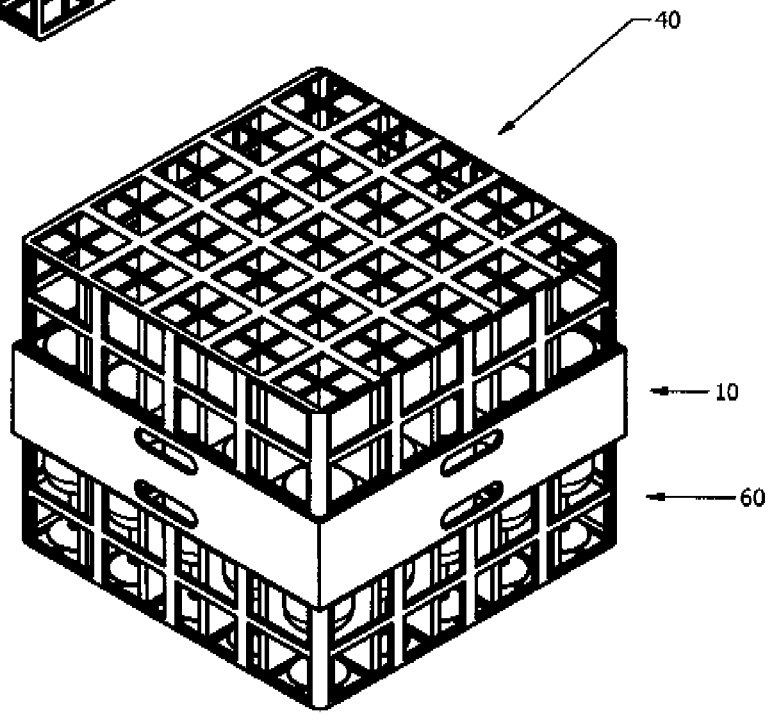
FIG. 12 is a perspective view of the assembly depicted in FIG. 10 rotated one hundred eighty degrees.

FIG. 11 is the assembly depicted in FIG. 10, except that the assembly has been rotated ninety degrees about Axis L. FIG. 12 shows the same assembly rotated a full one hundred eighty degrees (i.e., fully inverted) about Axis L with respect to the orientation depicted in FIG. 10.

As the assembly is rotated about the axis from the orientation shown in FIG. 10 through the orientation in FIG. 11, to the orientation in FIG. 12, the glasses 44 are urged to pass from the first rack 40, through respective ducts 14 of the apparatus 10, and into respective chambers of the second rack 60.

FIG. 12 is the entire assembly together in its inverted position, each glass 44 coming to rest within the rack 60 in an upright (i.e., bottom-down) configuration. The entire assembly may be rotated by hand on the one hand, or turned on its axis by a machine on the other. In either situation, the tedious chore of inverting each glass individually is eliminated.

Figure 13:
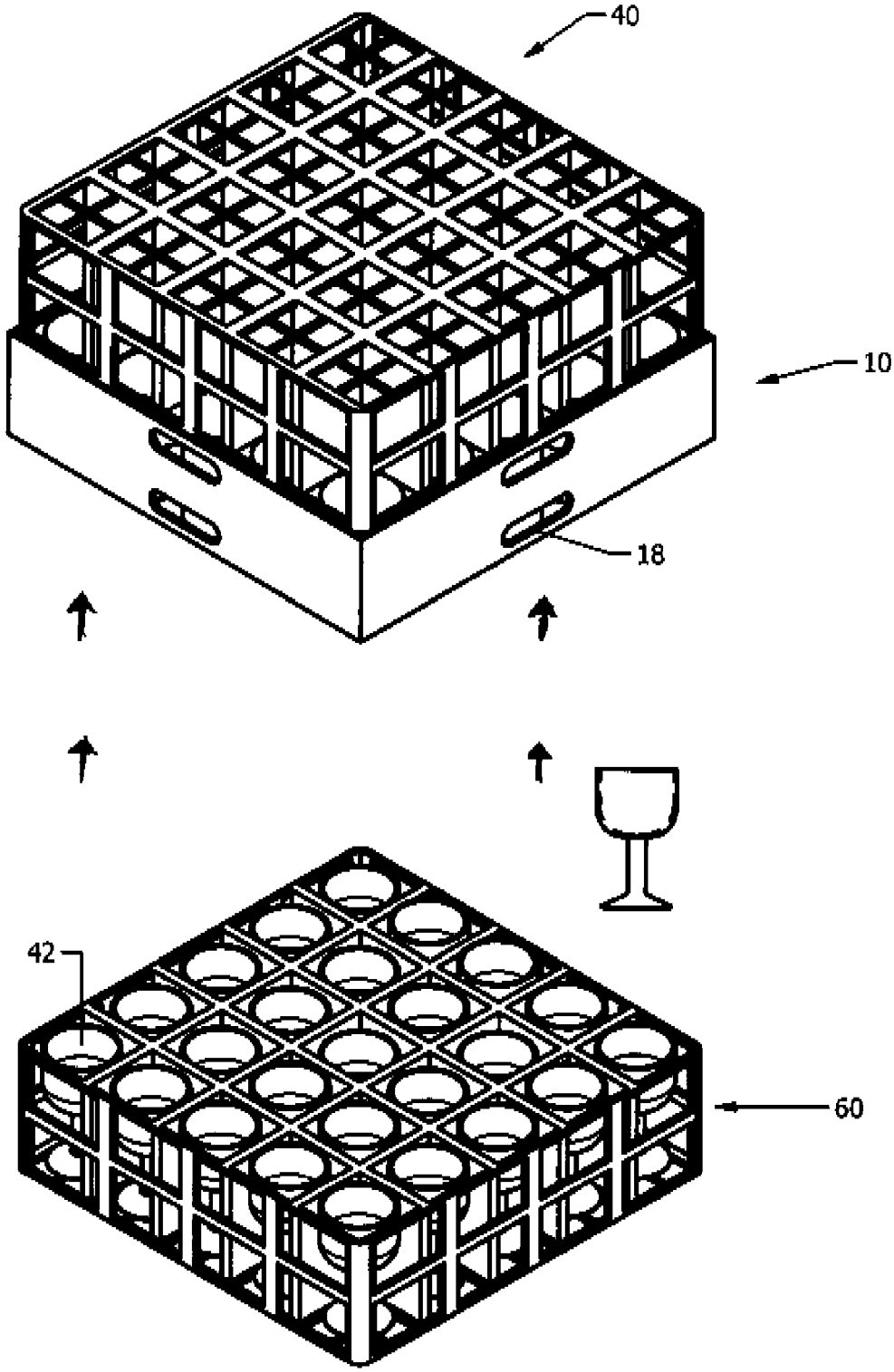
FIG. 13 is a perspective view of the assembly in its inverted condition with the apparatus together with the first glass beverage rack (now empty) being removed from the assembly.

FIG. 13 is a final step of the inventive method, wherein the assembly is taken apart by removing the apparatus 10 and the first rack 40, leaving the second beverage glass containment rack 60 containing an upright beverage glass 44 in each chamber 42 of the second beverage glass containment rack 60. The apparatus 10 and the first rack 40 can be removed from the assembly by lifting both up together, using thumb pressure on the first rack 40 and fore fingers engaging the grips 18 formed in a side wall 12 of the apparatus 10, leaving the glasses properly oriented in the second rack 60 so that each can be filled with ice and/or beverage. By lifting the first rack 40 and apparatus 10 together, this pair is prepared to mate with another rack of glasses requiring inversion.

Alternatively, the first rack 40 may be removed from the assembly, leaving the apparatus 10 to remain in engagement with the second rack 60. In this position, the ducts 14 help guide ice and/or beverage into each glass 44.

Although the invention and the drawings are described in detail, this description has been made for illustrative and example purposes only. The scope and breadth of the described invention is limited only by the terms of the appended claims.

I claim:

1. An apparatus for transferring glasses from a first beverage glass containment rack to an empty second beverage glass containment rack, each rack having side walls defining a perimeter, and each rack also having an upper edge, a bottom, and a plurality of chambers arrayed within the perimeter, each chamber being adapted to contain a beverage glass, the apparatus comprising:

side walls bearing edges adapted to engage the perimeter of the first beverage glass rack when in a mounted position atop the first beverage glass rack;

a center divider extending inwardly from the side walls and orthogonal the side walls;

a plurality of arrayed ducts, each duct coupled to the center divider and positioned such that each respective duct is positioned to fit within a respective chamber when in the mounted position; wherein, an assembly is formed by engaging the upper edge of the first containment rack with a bottom face of the center divider and engaging an upper edge of the empty second containment rack with a top face of the center divider; and wherein, beverage glasses are transferred from the first rack to the empty rack by inverting the assembly.

2. The apparatus as in claim 1, further comprising at least one grip positioned on a side wall.

3. The apparatus as in claim 2, wherein the at least one grip comprises apertures formed in the side wall.

4. The apparatus as in claim 1, wherein the apparatus frictionally engages around the perimeter of the first beverage glass containment rack.

5. The apparatus as in claim 1, wherein each duct has edges that are angled with respect to the center divider.

6. The apparatus as in claim 5, wherein the assembly is inverted by rotating the assembly about an axis passing through the center divider; and wherein, the angled duct edges are disposed such that a raised portion is distal the axis.

7. The apparatus as in claim 1, wherein each duct has a circular cross-section.

8. The apparatus as in claim 1, wherein each duct comprises a pliable material.

9. The apparatus as in claim 1, wherein each duct has edges that are parallel the center divider.

10. A method of transferring glasses from a first beverage glass containment rack to an empty second beverage glass containment rack, the method comprising the steps of:

providing a first beverage glass rack having side walls, an upper edge, a bottom, and a plurality of chambers arrayed within its interior, each chamber being adapted to contain a beverage glass;

placing at least one beverage glass within the first beverage glass rack;

providing an empty second beverage glass rack having side walls, an upper edge, a bottom, and a plurality of chambers arrayed within its interior, each chamber being adapted to contain a beverage glass;

providing an apparatus having side walls that bear upper edges adapted to engage the perimeter of each beverage glass rack, the apparatus also having a center divider orthogonal to and interior the side walls;

positioning a plurality of ducts, each passing through and coupled to the center divider;

placing the apparatus to engage around the first beverage glass rack such that the center divider engages the top edge of the first beverage glass rack, and each respective duct engages within a respective chamber;

turning the empty second, empty beverage glass rack upside-down;

forming an assembly by placing the second, empty beverage glass rack atop the apparatus and engaging an upper edge of the empty second beverage glass rack with the center divider and, inverting the assembly;

removing the first beverage glass containment rack from the assembly, wherein, the at least one beverage glass contained within the first rack transfers to the empty second rack during the inverting step.

11. The method as in claim 10, further including the step of positioning at least one grip on a side wall.

12. The method as in claim 11, wherein the at least one grip comprises apertures formed in the side wall.

13. The method as in claim 10, wherein the apparatus frictionally engages around the perimeter of the first beverage glass containment rack.

14. The method as in claim 10, wherein each duct has an upper edge that is angled with respect to the center divider.

15. The method as in claim 14, wherein the inverting step is performed by rotating the assembly about an axis passing along a line of symmetry on the center divider; and wherein, angles of the upper duct edges are such that a high portion of each duct edge is distal the axis.

16. The method as in claim 10, wherein each duct has a circular cross-section at planes parallel to the center divider.

17. The method as in claim 10, wherein each duct comprises a pliable material.

18. The method as in claim 10, wherein each duct has an upper edge that is parallel the center divider.

19. An apparatus for transferring beverage glasses from a first beverage glass containment rack to an empty second beverage glass containment rack, each rack having side walls defining a perimeter, and each rack also having an upper edge, a bottom, and a plurality of chambers arrayed within the perimeter, each chamber being adapted to contain a beverage glass, the apparatus comprising:

side walls bearing edges adapted to engage the perimeter of the glass rack when in a mounted position atop the first beverage glass rack;

at least one grip positioned on a side wall;

a center divider extending inwardly from the side walls and orthogonal the side walls;

a plurality of arrayed ducts, each duct having a circular cross-section and each duct being within the side walls and coupled to the center divider such that each respective duct is positioned to fit within a respective chamber when in the mounted position, each duct having edges that are angled with respect to the center divider; wherein, an assembly is formed by engaging the upper edge of the of the first containment rack with a bottom face of the center divider and engaging the upper edge of the empty second containment rack with a top face of the center divider; and wherein, beverage glasses are transferred from the first rack to the empty rack by rotating the assembly about an axis through the center divider.

* * * * *